US007677950B2

(12) United States Patent
Mutschler

(10) Patent No.: US 7,677,950 B2
(45) Date of Patent: Mar. 16, 2010

(54) DECORATIVE ELEMENT FOR THE HUMAN BODY

(75) Inventor: Friedolf Mutschler, Ochsenhausen (DE)

(73) Assignee: Real Estate Vienna, Appenzell (CH)

( * ) Notice: Subject to any disclaimer, the term of this patent is extended or adjusted under 35 U.S.C. 154(b) by 0 days.

(21) Appl. No.: 12/130,961

(22) Filed: May 30, 2008

(65) Prior Publication Data

US 2008/0293327 A1 Nov. 27, 2008

Related U.S. Application Data

(63) Continuation of application No. PCT/EP2006/010842, filed on Nov. 13, 2006.

(30) Foreign Application Priority Data

Dec. 2, 2005 (DE) ..... 10 2005 057 711

(51) Int. Cl.
*A41C 3/00* (2006.01)

(52) U.S. Cl. ..... 450/41; 2/255

(58) Field of Classification Search ..... 450/1, 450/41–45, 54–58; 63/2, 1.1, 14.1, 14.8; 2/255–260, 260.1, 261–264
See application file for complete search history.

(56) References Cited

U.S. PATENT DOCUMENTS

| | | | | |
|---|---|---|---|---|
| 2,701,879 | A | 2/1955 | Bennett | |
| 4,394,781 | A | 7/1983 | Axmann | |
| 5,239,841 | A * | 8/1993 | Zwart | 63/12 |
| 5,755,611 | A | 5/1998 | Noble et al. | |
| 5,967,876 | A * | 10/1999 | Kollmanthaler et al. | 450/41 |
| 6,082,138 | A * | 7/2000 | Meehan | 63/14.8 |
| 6,257,951 | B1 | 7/2001 | DeMarco | |
| 6,758,061 | B1 * | 7/2004 | Croft | 63/14.8 |
| 6,938,440 | B2 * | 9/2005 | Smith | 63/1.18 |
| 2001/0021620 | A1 | 9/2001 | DeMarco | |
| 2005/0079796 | A1 | 4/2005 | Chou | |

FOREIGN PATENT DOCUMENTS

| | | | |
|---|---|---|---|
| BE | 461513 | A | 12/1945 |
| DE | 1810747 | A | 8/1969 |
| DE | 20201506 | U1 | 8/2002 |
| DE | 202004010174 | U1 | 10/2004 |
| EP | 0495278 | A1 | 7/1992 |
| FR | 2126472 | A | 10/1972 |
| GB | 1105147 | | 3/1968 |
| GB | 2408911 | A | 6/2005 |
| GB | 2409399 | A | 6/2005 |

OTHER PUBLICATIONS

Search Report from German Patent and Trademark Office, 4 pages (Jun. 21, 2006).
Examination Report from German Patent and Trademark Office, 6 pages (Jan. 3, 2007).
International Search Report, 4 pages (Jan. 26, 2007).

* cited by examiner

*Primary Examiner*—Gloria Hale
(74) *Attorney, Agent, or Firm*—The Maxham Firm

(57) ABSTRACT

A decorative element for the human body in the form of a breast clasp which can be worn on the person. One breast clasp can be worn in the crease beneath a female breast and is held in place by means of a clamping and adhesive effect. The breast clasp is designed as a curved element and performs a shaping or supporting function, or both, for the female breast.

17 Claims, 12 Drawing Sheets

DECORATIVE ELEMENT FOR THE HUMAN BODY

FIELD OF THE INVENTION

The invention relates to a decorative element for the human body, in particular a breast clasp for the female breast.

DISCUSSION OF PRIOR ART

According to German Utility Model DE 299 09 775 U1, for shaping the female breast it is known to associate each breast with a bra underwire situated in a tunnel fabric of a bra. The bra cups extend upward from the tunnel fabric, and the front ends of the cups engage with supports which at their rear region are joined to the band below the breast. In this manner the known bra acquires a supporting and shaping function. However, the known bra underwires are not used for shaping the female breast but, rather, only hold the tunnel fabric of the bra in order to form a counterbearing or support bearing for the actual bra cup. Consequently, the supporting or shaping function is derived from the fabric of the bra, whereby the bra underwire constitutes only the counterbearing. In this regard it is important that the bra underwire does not exert pressure on the female breast or the surrounding body parts to ensure comfort in wearing the bra.

However, a drawback of the known bra is that the bra underwires as such are not visible, and have only a subordinate function in the bra. Thus, it is not possible to provide an additional decorative item for the female breast which projects beyond the bra.

German Utility Model DE 20 2004 010174 U1 discloses an article of clothing having a clamping device, and by means of a clamping effect the article of clothing is held against the body of a person wearing the article. It cannot be inferred from this document that the disclosed clamping device, in addition to its clamping effect, has a holding effect as the result of the breast of a female body pressing on the clamping device.

U.S. Pat. No. 6,257,951 discloses a pliable, strapless bra containing integrated elements for supporting both breasts, whereby during use two cups made of pliable foam together with a shaping mechanism lie against the breasts, the shaping mechanism having a plurality of flexible metal strips within the cups, situated between two pliable foam layers of the pliable foam cups. This structure is disadvantageous in that the metal strips integrated into the bra do not allow a female breast to be independently supported, since the metal strips themselves do not have a clamping effect.

French patent publication FR 2 126 472 A discloses a female swimwear article having two cups, each containing a fitting which extends over a portion of the edge length, and each cup on its inner surface having at least one adhesive band in the vicinity of the edge. A holding clip for automatically holding a female breast is not suggested by this document.

United States patent publication 2005/079796 A1 discloses a self-adhesive bra which is free of shoulder straps and back straps and is permeable to air and, at its inner side, incorporated in co-construction, is entirely or partially joined at a defined location to a self-adhesive layer made of silica gel or similar adhesive material. This structure is disadvantageous in that a holding clip for an automatic holding effect cannot be inferred.

U.S. Pat. No. 2,701,879 discloses a self-adhesive breast cup having a light, rigid, uniform crown having essentially parallel straight sides and a curved lower section which joins the sides to one another, and the crown is modified around the sides and the lower border for attachment against the body. The crown has large support cutouts provided in the sides, through which portions of the bra protrude, and has a downwardly directed, inclined, forwardly projecting element in the curved lower section for shaping the bra. The rectangular connection of the sides are designed in such a way that the crown is able to protect the entire bracing from the contacting part of the body and from the lower side portion of the bra next to the body. A drawback to this design is that the clip-shaped bracing does not provide an automatic holding effect on the bodily surface.

German patent publication DE 31 11 280 A1 discloses a swimwear article in which the bra has a molded insert which encloses approximately two-thirds of each breast and is situated inside the air-permeable material of the bra. The molded insert of this structure provides no automatic support on the bodily surface.

Belgian patent BE 461 513 discloses a bra having two fittings which have a fabric for covering the female breast, and have laterally situated holding elements which have a flexible design and surround the body. In this document it is likewise disadvantageous that the disclosed holding elements do not provide an automatic holding effect; instead, they are held on the bodily surface by means of laterally situated holding elements.

U.S. Pat. No. 5,755,611 discloses a bra having soft, natural breast-shaped cup elements for receiving a portion of the breast, and a flat, peripheral flange portion which may be secured to the wearer's body immediately beneath the breast by adhesive tape and renewable adhesive to allow the device to be worn repeatedly. A disadvantage of this design is that the strips are provided with adhesive, thereby preventing the straps from being automatically held.

SUMMARY OF THE INVENTION

A purpose of the present invention is to provide a decorative element which may be worn completely independently of and separately from the bra, for decoration of the female breast, by means of which the breast may be decorated in a completely new way, and may also be partially shaped.

The term "decoration" is understood to mean all known decorative elements or wearable functional elements.

In the context of the invention described below for a "breast clasp," the starting point was to determine the specific decorative items used for the female breast through history. There have been numerous decorative elements having a covering and framing function, but these elements all share the common feature that they can be worn on the body only by use of holding elements of various designs. Affixing bodily decorations by piercing is a very old technique of attaching decorative elements to the body.

All of these decorative items share the common feature that they are not based on the fundamental shape of the female breast itself in order to be held on the breast in a "self-supporting" function. Even the use of hypoallergenic adhesive materials or silicones currently offers only the option of simply making an attachment to the body, regardless of the individual bodily shape, by use of adhesives.

Accordingly, an aim of the invention described in detail below is to provide a decorative item which naturally conforms to the shape of the female breast, is held by same, and is conceivably easy to apply and remove. The basic shape to be used should also be a decorative element by itself as a support, having any given design, for supplemental decorative elements.

In the classification of bra cup sizes (A-C, for example), it has been found that in the past 20 years the percentage of wearers of cup size "A," the smallest size, has decreased considerably, in that currently only approximately 21% of women require this cup size. Thus, 79% of women wear cup size "B" and "C" or larger.

All B and C cup sizes share the common feature that the breast in its natural shape, which is enclosed by the cup, develops a more or less pronounced bodily crease at the respective bottom and side region. This bodily crease is created by the natural intrinsic weight of the breast, which in the B and C cup sizes is compressed by an average intrinsic weight of the breast of 1.5 to 3.6 kg. This produces a bodily crease which remains closed even during normal movement.

A half moon-shaped curved clasp integrated into such a bodily crease is held in place at that location, and in an appropriate design may be shaped into a bodily decoration hitherto unknown: the breast clasp.

One aspect of the invention is that the breast clasp, in each case in the form of a curved element, can be worn in the crease beneath the female breast, and is held in place by a clamping and/or adhesive effect. This achieves the significant advantage that an independent decorative element is provided which comprises, for example, a curved or strip-shaped element that is worn in the crease beneath the female breast. The aim is for the breast clasp according to the invention to develop a gentle clamping effect so that it cannot fall out from the crease beneath the breast, even when the arms are raised. In this regard it is also important that the breast clamp is held by the weight of the female breast pressing thereon, and therefore is not readily visible from the front side of the female body.

This is advantageous, since according to the invention the parts of the breast clasp extending over the breast are provided with associated decorative, supporting, and functional elements. Breasts decorated in this manner become a bodily area which may be fashioned in many variations.

Without the need, for example, of piercing the human skin, or inducing the sensation of continuously perspiring when flat adhesive silicone cups are used, such a breast clasp is a totally natural decorative element which, due to the ability of the body to become habituated to pressure, is no longer perceived a very short time after being applied.

Due to the fact that such a breast clasp exerts a certain clamping pressure on the female breast on at least three sides, the female breast is not only decorated, but also slightly elevated (push-up effect) and shaped. A similar basic shape is found in bra underwires, whose function is to distribute the tensile and lifting forces of a bra uniformly on the bra support, thereby also maintaining the basic textile shape of a bra.

However, it is in this specific function that a breast clasp differs significantly from the known forms of a bra underwire, which in a substantially rigid form should cause as little deformation of the enclosed breast as possible, and in its design and integration of textiles it is not capable of being either a visible decorative element as such or a support for supplemental decorative elements.

The invention relates not only to individual curved breast clasps, which in each case may be worn beneath a female breast, but also to the joining of two curved elements which together form an eyeglass-like frame which as a cohesive unit is worn beneath both breasts.

In a further design, the breast clasp is made of suitable materials which allow the breast clasp to be freely shaped, and thus adapted to the individual breast in an anatomically favorable manner.

The breast clasp may comprise individual cohesive segments which are connected to one another in an articulated manner, or these segments may even be clamped together using a clamping device, thus allowing a desired curved shape to be achieved corresponding to the tension between the segments.

The segments may also have a tetrahedral profile in order to define the curved shape of the breast clasp when the segments are twisted.

Of course, the invention is not limited to a curved, strip-shaped element which must be worn in the crease beneath the breast. Starting from this element, it is possible for corresponding vertical elements, fan elements, or grid elements to extend upward toward and enclose the female breast.

In all embodiments it is important that the breast clasp itself does not require a lower strap or a circumferential back strap. However, the invention is not limited thereto, since other embodiments are possible in which the breast clasp is provided with associated shoulder straps or back straps. In this manner the decorative element may also represent a complete decorative detail in which the breast clasps according to the invention also include shoulder and back straps.

In one preferred embodiment of this concept, the two breast clasps are also joined together by a flexible back clasp, resulting in an approximately C-shaped design for the overall element, with the back clasp enclosing the wearer's back, at which location it may bear additional decorative and functional elements.

This back clasp does not necessarily have to surround the wearer's back; it may also be brought only partially to the back and, for example, surround only the side regions of the back.

In all embodiments it is also important that the breast clasp does not have to be curved only in the X-Y plane; it may also undergo a three-dimensional deformation (X-Y-Z plane) to achieve an even better fit to the female anatomy.

The invention also provides for a design of the breast clasp as an elastic element made of an elastic wire, plastic, or plastic/metal composite, or a similar element which is freely pliable in the X and Y planes but elastically returns to its original shape.

In a second embodiment, the breast clasp is made of a rigid material of only limited flexibility which exerts relatively high clamping forces. Examples of such a material include horn, steel, or plastic of suitable thickness.

In a third embodiment, the element is pliable but also rigid in places, with some sections of the breast clasp having a flexible and/or pliable cross section whereas other sections have a rigid, nonpliable design.

The profile shape of such a breast clasp may also be modified within a broad range. Particularly preferred is a two-legged profile shape in which the two profile legs are united in a base leg which is supported in the crease beneath the breast. In this manner these two legs perform a certain contact function on the associated skin areas of the wearer, thereby increasing wear comfort.

The surface of the breast clasp may also be modified within a broad range. The surface may have a completely smooth, coated, or also adhesive design, and may be roughened or profiled. Transverse and/or longitudinal patterns may be provided, or individual knobbed patterns and/or or planar indentations may be spaced at a distance on the surface of the breast clasp.

BRIEF DESCRIPTION OF THE DRAWING

The purposes, features, and advantages of the invention will be more readily perceived from the following detailed description, when read in conjunction with the drawing, wherein.

DETAILED DESCRIPTION OF THE PREFERRED EMBODIMENTS

Firstly, it is noted that the breast clasp, also in its "bare" configuration, is used as a decorative element in and of itself, irrespective of the illustrated exemplary embodiments. Thus, the designs of the decorative clasp, described below, in the form of a support element for decorative items or functional articles, go beyond this simple embodiment, and are likewise generally considered to be part of the invention.

Figure 1:
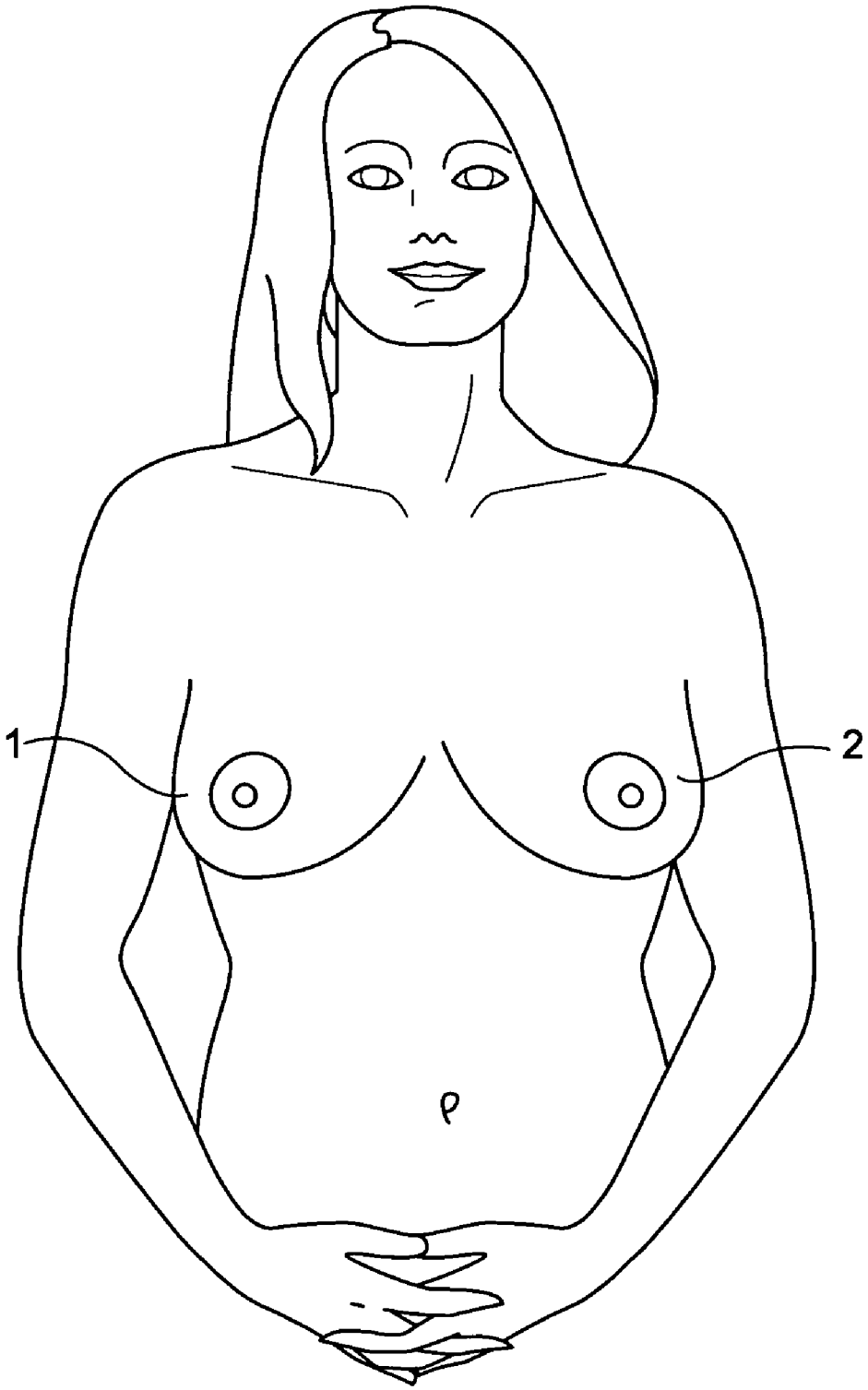
FIG. 1 is a schematic illustration of a female body in the front view.
Figure 2B:
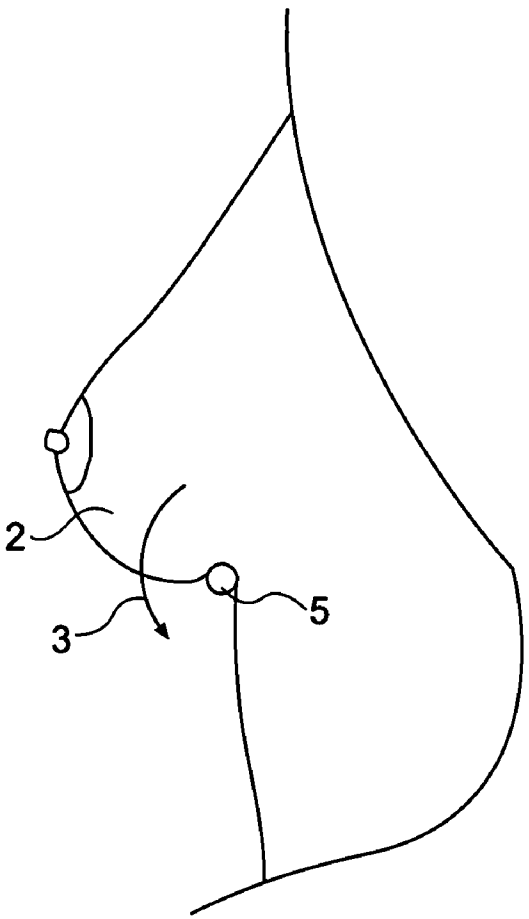
FIG. 2 shows the function of a breast clasp in accordance with the invention in a partial side view.
Figure 2A:
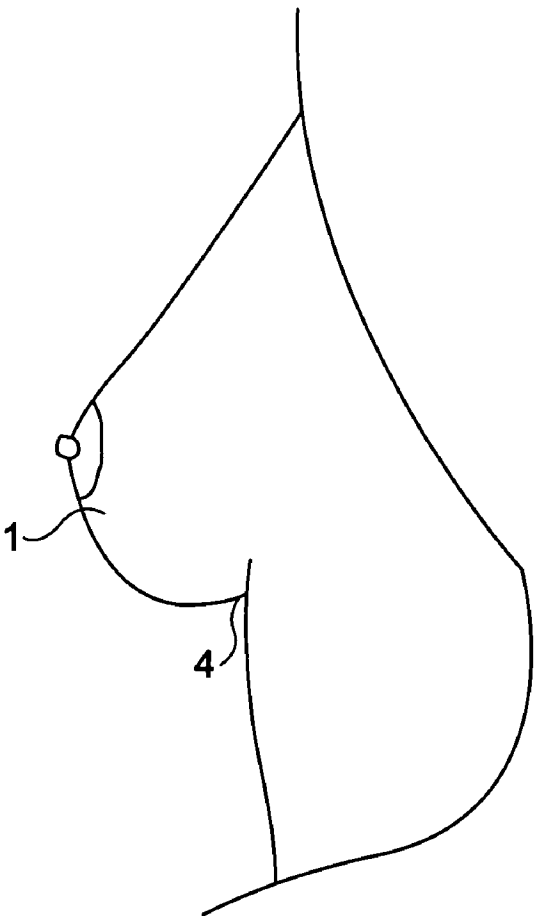

FIG. 1 illustrates in a general way a female breast 1, 2 and FIG. 2 shows the manner in which a crease 4 beneath the breast is formed on the underside of the female breast. The female breast tends to sag downward in the direction of arrow 3, thereby closing the crease 4 beneath the breast. According to the invention a breast clasp 5 is provided in the region of this crease beneath the breast, and may be designed according to one of the exemplary embodiments described below.

Figure 3:
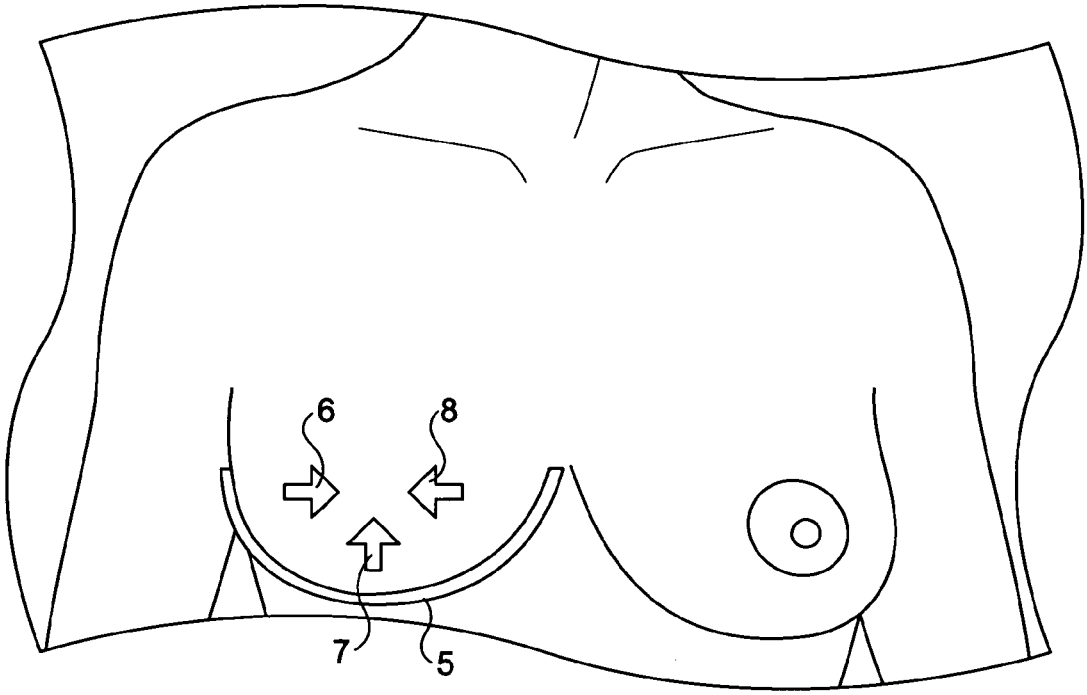
FIG. 3 shows the function of a breast clasp of FIG. 2 in the front view.

Wear comfort results from the configuration according to FIG. 3, since the breast clasp preferably has a clamping design such that it exerts an inward clamping effect in arrow directions 6, 7, 8 and is thus fixed in place in the crease beneath the breast.

Figures 4A, 4B:
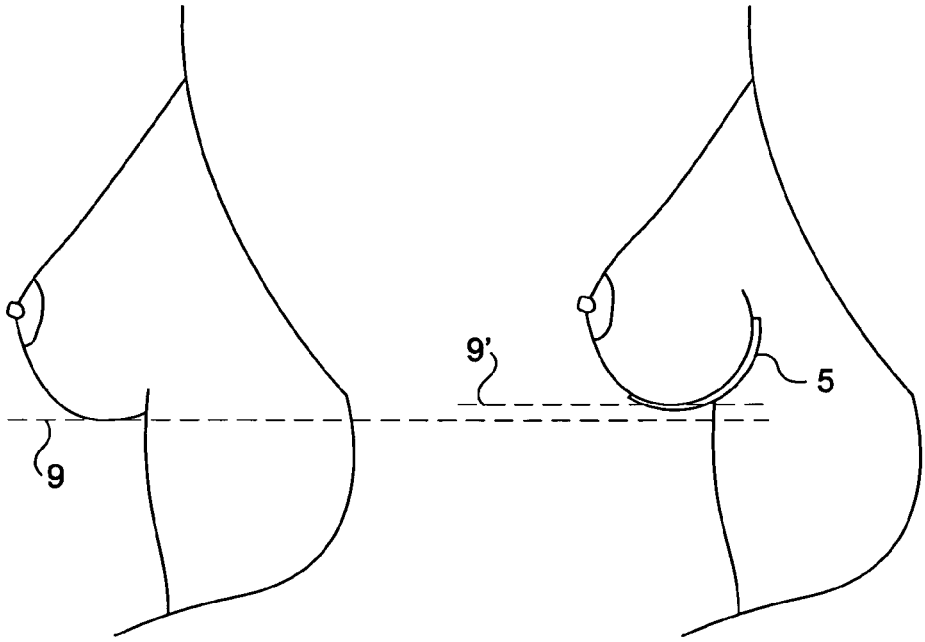
FIG. 4 shows the function of a breast clasp according to a further functional feature.
Figure 5A:
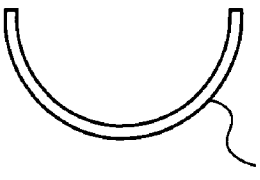
FIG. 5 shows four different embodiments of breast clasps having the shape of circular segments.
Figure 5B:
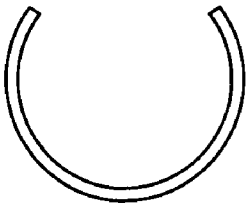
Figure 5C:
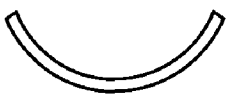
Figure 5D:
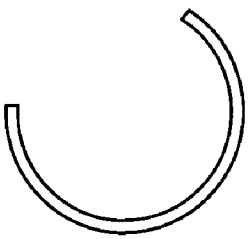

According to FIG. 4, the breast clasp 5 used in this manner also has a certain lifting function. The female breast 1, 2 provided with the breast clasp 5 is thereby lifted from line 9 to line 9' due to the clamping effect according to FIG. 3.

FIG. 5 illustrates various embodiments of a breast clasp 5*a*-5*d*, wherein each breast clasp 5 comprises a circular segment, and the original circle radius may be broken into different lengths for arc angles running in the same direction.

Figure 6:
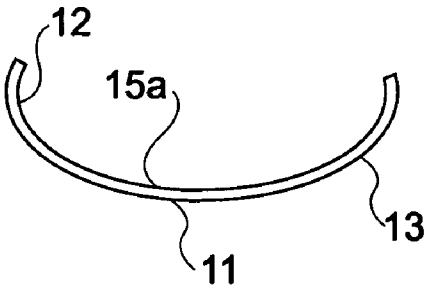
FIG. 6 shows two different embodiments of curved elements.
Figure 6:
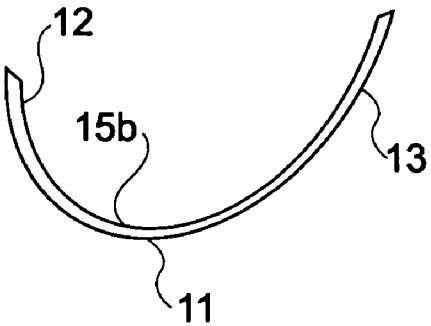

In contrast, FIG. 6 shows that a curved element of a breast clasp 15 may also comprise a supplement of various circular segments having different arc angles, resulting in a smooth transition between the individual arc angles. In comparison to the circular segments illustrated in FIG. 5, the curved elements 11, 12, 13 comprise lines of different curvature which continuously merge into one another, forming the illustrated shapes of breast clasps 15.

Figure 7A:
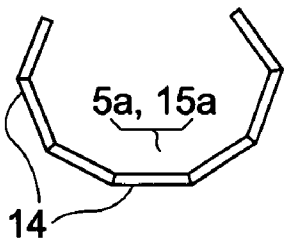
FIG. 7 shows three different embodiments of curved breast clasps having segmented linear elements.
Figure 7B:
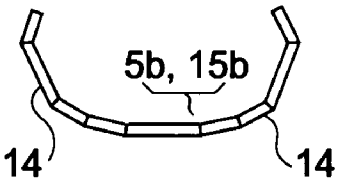
Figure 7C:
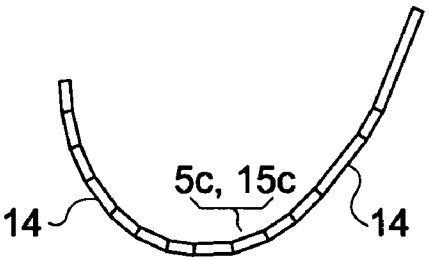

The invention is not limited to continuous cross sections according to FIGS. 5 and 6. According to FIG. 7, a curved configuration according to FIGS. 5 and 6 may also be realized by the use of segments 14 which merge into one another. The segments 14 abut one another to either form corresponding edges and being joined together as a single material piece, or are continuously joined together as shown in the illustration of the breast clasp 5*c*, 15*c* according to FIG. 7.

Figure 8A:
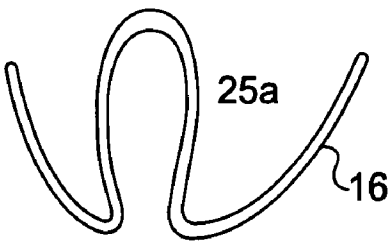
FIG. 8 shows a nose-shaped clasp design which is freely deformable.
Figure 8B:
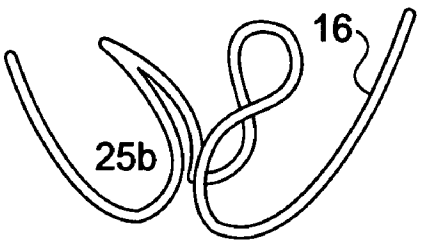

FIG. 8 shows nose-shaped clasp designs in any number of conceivable shapes, wherein the actual clasp function is maintained by virtue of the illustrated flexural element 16 being able to freely bend in any shape in order to be inserted in the crease 4 beneath the female breast and be firmly clamped at that location.

Figure 9A:
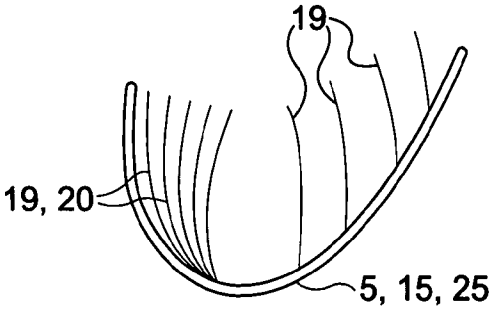
FIG. 9 shows a basic clasp shape in a quill-like function as a support for additional elements laterally positioned with any given spacing.
Figure 9B:
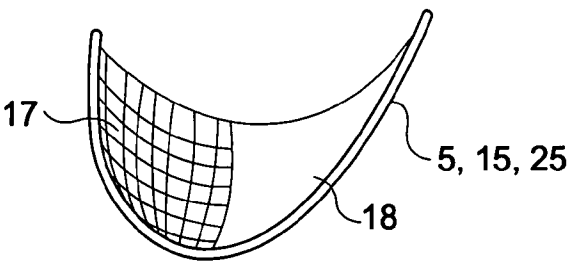

FIG. 9 shows a basic clasp shape having a quill function. Any given breast clasp 5, 15, 25 according to the above illustrations is joined to additional vertical elements 19 which at least partially surround the female breast from below, and likewise serve as a decorative element. The top left illustration in FIG. 9 shows that the vertical elements 19 may also be combined with one another in the region of the breast clasp to form vertical fans 20. The lower portion of FIG. 9 shows that the respective breast clasp 5, 15, 25 may also optionally be connected to grid elements 17 or shell elements 18.

Figure 10A:
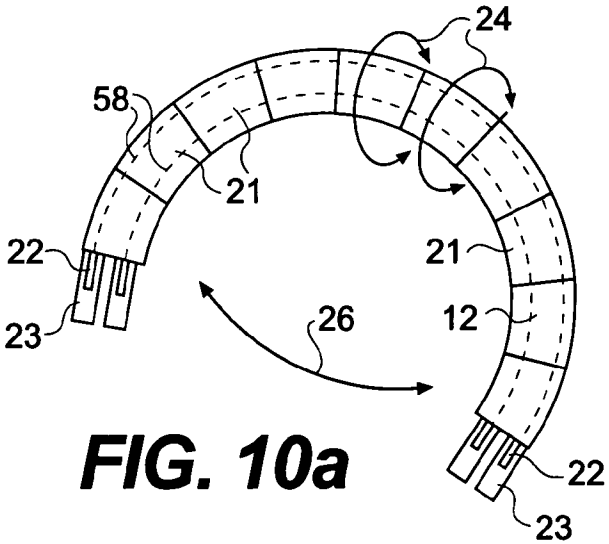
FIG. 10 shows a basic clasp shape composed of individual movable shaped elements which are clamped by means of a clamping device.
Figure 10B:
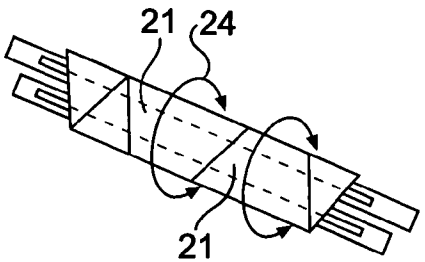

FIG. 10 shows a basic clasp shape composed of individual movable shaped elements which, beaded on one or more cables, may be compressed at their respective cable ends by a suitable clamping device, thus forming a solid unit. If one or more of such movable shaped elements have a diamond-shaped or rhomboid design or similarly differing planar design, such an arrangement may have any conceivable shape and be clamped so as to have varying radii. Such a clamping technique allows a breast clasp to be fitted precisely to any bodily contour. This principle may likewise be transferred for use on bracelets and necklaces, independent from the breast clasp. Furthermore, this technical variant provides numerous design possibilities, in that it is possible to vary, supplement, or exchange not only the basic shape but also the individual shaped elements.

FIG. 10 also illustrates two parallel screw devices 22 which are respectively screwed onto a nut 23. The screw devices 22 pass through the hollow segments 21 in the form of cables, and when the respective screw device 22 is tightened the shape of the curve is changed in arrow direction 26.

In another embodiment the individual segments 21, having a tetrahedral shape, for example, may also be rotatable in arrow directions 24 in order to likewise change the shape of the curve in arrow direction 26.

Instead of a tetrahedral shape, the segments 21 may also have a triangular shape, and corresponding to their rotation may change the curvature of the breast clasp.

Figure 12A:
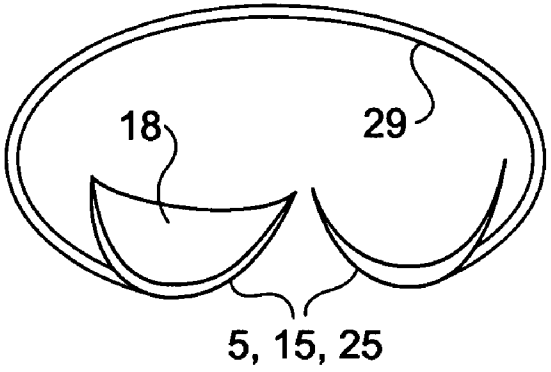
FIG. 12 shows an enhanced two-part breast clasp having a back clasp.
Figure 12B:
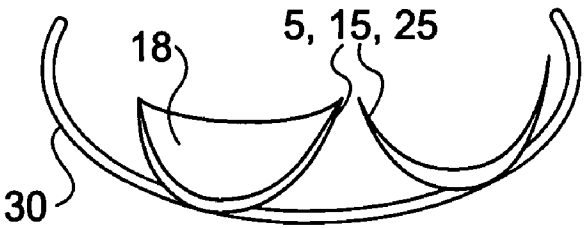
Figure 11A:
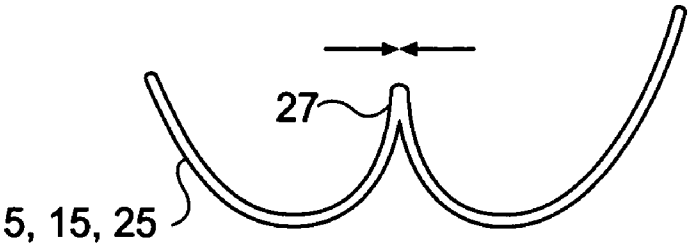
FIG. 11 shows two embodiments of a two-part breast clasp.
Figure 11B:
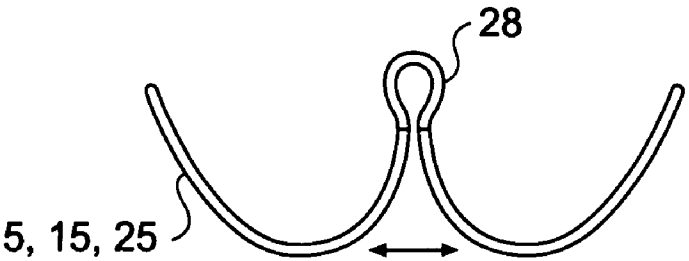

FIGS. 11 and 12 show contiguous breast clasps 25 in which the breast clasps previously illustrated are joined together via an associated rigid connecting element 27 (upper illustration in FIG. 11) or a flexible connecting element 28. Functional and/or decorative elements may also be provided in the region of these connecting elements 27, 28.

FIG. 12 shows the basic shape of the breast clasp supplemented by protruding shaped elements which include the upper body in the breast or back region in a specified or adjustable length. Such a technology could also be used as a support structure for unusual bra designs.

The upper portion of FIG. 12 shows a back clasp 29, extending over the back, which joins the two breast clasps 5, 15, 25 together, whereas in the lower portion of FIG. 12 such a back clasp 30 only partially surrounds the wearer's back.

Figure 13A:
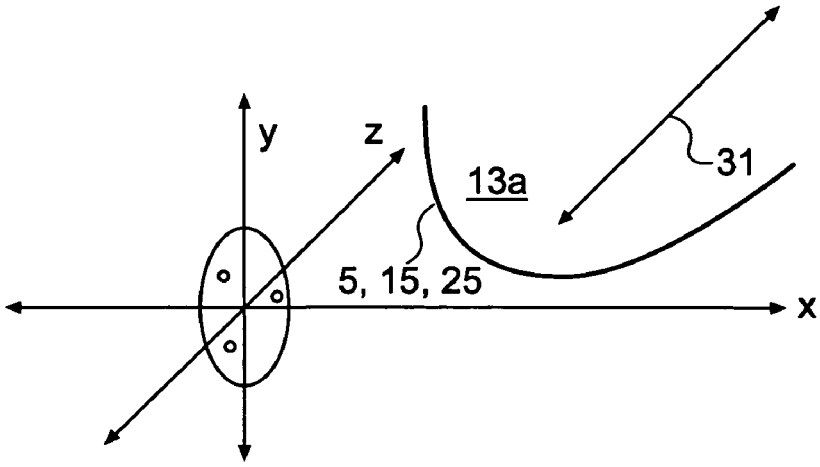
FIG. 13 shows the representation of a breast clasp deformed in two and three dimensions.
Figure 13B:
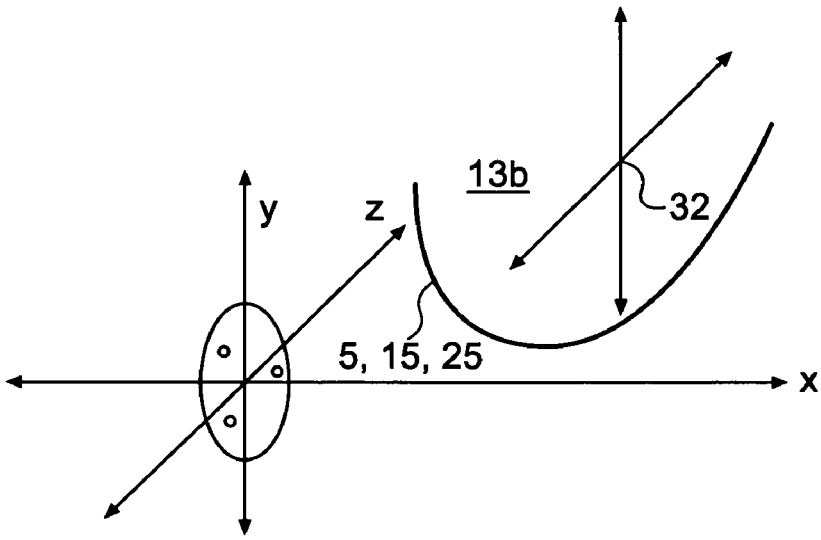

The upper illustration in FIG. 13 shows that the breast clasp is curved only in the X-Y plane, and is thus oriented in a planar area 31. In contrast, the lower illustration in FIG. 13 also shows a three-dimensional flexure, so that according to the present invention the breast clasp may also be curved in the X-Y-Z plane. For such a shape, the individual curved elements are situated only at a single point or, in a type of arched shape, are situated on multiple horizontal planes in the manner of a helix.

Figure 14A:
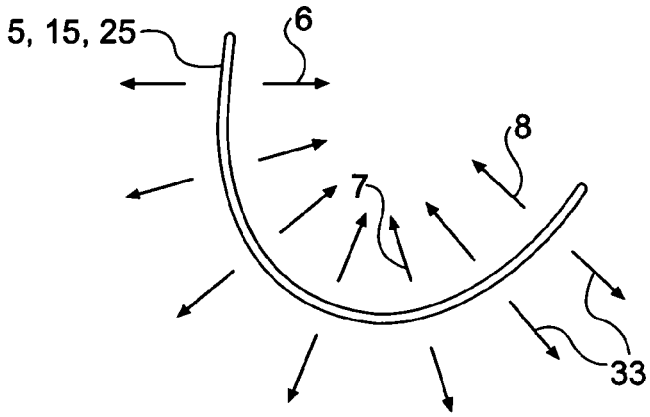
FIG. 14 shows the function diagram for the elastic, flexible, or rigid clasp function of the breast clasp.
Figure 14B:
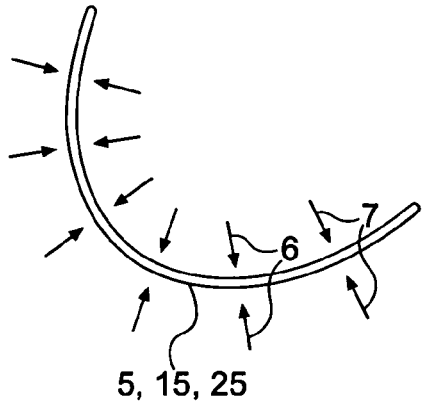
Figure 14C:
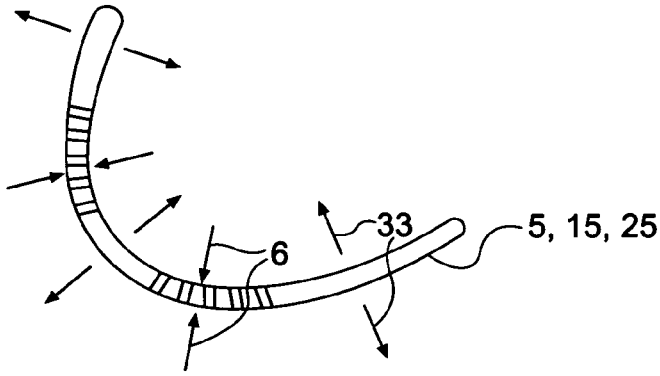

The upper illustration in FIG. 14 shows that the curved element is elastic in all regions. This is represented by arrows 6, 7, 8, 33 with all arrows preferably being situated in the X-Y plane. However, the invention is not limited thereto, since it is also possible for the breast clasp to exert a corresponding clamping effect in the Z plane as well (perpendicular to the plane of the drawing). The center illustration in FIG. 14 shows that the curved element is bent and remains in this position, whereas the lower portion of FIG. 14 shows a partially elastic design in which a curved element is composed of subelements of variable deformability. Thus, this is a combination of the designs according to the top two illustrations in FIG. 14.

Figure 15A:
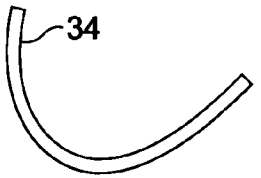
FIG. 15 shows various planar longitudinal profiles in the form of a breast clasp in three different embodiments.
Figure 15B:
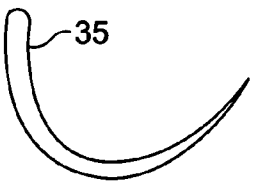
Figure 15C:
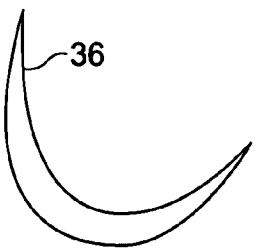

FIG. 15 shows longitudinal profiles of the individual clasp elements which, viewed from the top, may be either continuously parallel, arched, or in a transition form having both shapes. These are planar elements 34, 35, 36 wherein planar element 34, viewed from the top, for example, has a parallel surface from one tip to the other, planar element 35 has a half moon-shaped contour with one tip, and planar element 36 has a half moon-shaped contour with two tips.

Figure 16:
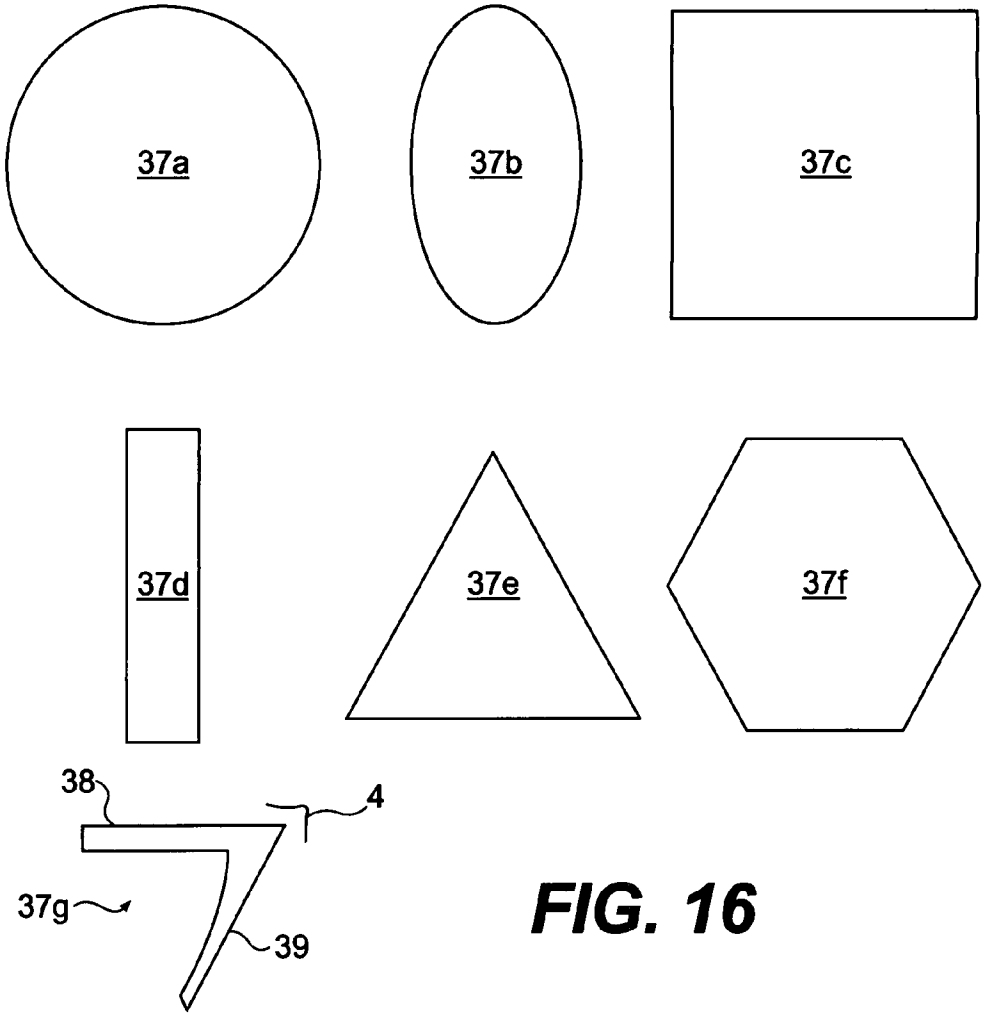
FIG. 16 shows various profile shapes of breast clasps.

FIG. 16 illustrates a plurality of different profile shapes 37*a*-*g*. All of the profile shapes are possibly used with the invention.

The circular profile shape 37*a* is the simplest shape, and results in high wear comfort. This is also the case for an elliptical shape according to profile 37*b*. Profile shapes 37*c*-37*f* can be present only on a piecewise basis, that is, at specific locations on the breast clasp, whereas other profile shapes are present at the other locations. However, the profile shapes may also be provided in a continuous manner.

Profile shape 37*g* comprises two legs 38, 39, situated at an angle with respect to one another, which are united in a base leg which lies in the crease 4 beneath the breast. This results in the advantage that the one leg 38 provides a certain support function on the underside of the female breast and this force transmission is conveyed from the leg 39 to the front side of the female body. This results in a particularly high level of wear comfort.

The illustrations in FIG. 17 show various clasp surfaces. Independent of the specified cross sections of a breast clasp, the surface thereof may have diverse shapes with various design and adhesion characteristics. In this case the principle applies that, in contrast to a smooth design (FIG. 17*a*), roughened structures (FIG. 17*b*) or structures with increased surface area (FIG. 17*c*) provide a better fit to the body.

A parallel or intersecting longitudinal pattern (FIG. 17*c*) is also possible. Exceptional adhesion to the body results when a smooth breast clasp is enclosed by a thin spiral spring, thereby combining roughness with a high degree of elasticity. Transverse profiles situated at specific points (FIG. 17*d*) or arbitrarily positioned knobs (FIG. 17*e*) may also contribute greatly to the adhesion characteristics.

As represented here, surface 40 may have either a smooth or an adhesive design, and likewise surface 41 may be roughened, or surface 42 may be provided with longitudinal patterns.

Figure 17A:
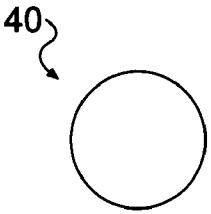
FIG. 17 shows various exemplary embodiments for the design of the clamp surface.
Figure 17B:
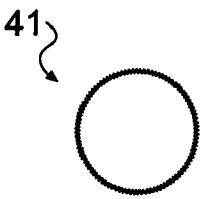
Figure 17C:
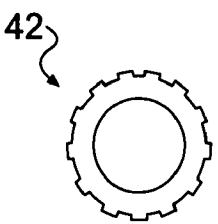
Figure 17D:
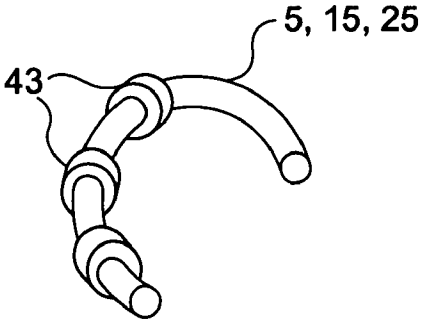
Figure 17E:
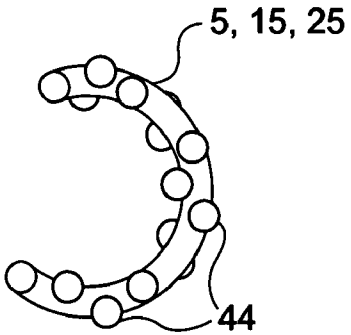

Exemplary embodiment FIG. 17*d* shows that adhesive elements or annular elements may be situated in a piecewise, uniformly spaced manner on the material of the breast clasp 5, 15, 25 and optionally may also be displaceable. On the other hand, exemplary embodiment FIG. 17*e* shows that adhesive elements 44 may be securely provided on the surface of the respective breast clasp 5, 15, 25 in the form of knobbed elements.

All of the referenced clasp elements, in addition to the individual position, may also be worn in any given supplements, independently of one another or joined together.

Such breast clasps may be provided continuously or in a combined shape, and are preferably made of dimensionally stable materials such as metal, plastic, glass, wood, horn, or other natural products.

Figure 18:
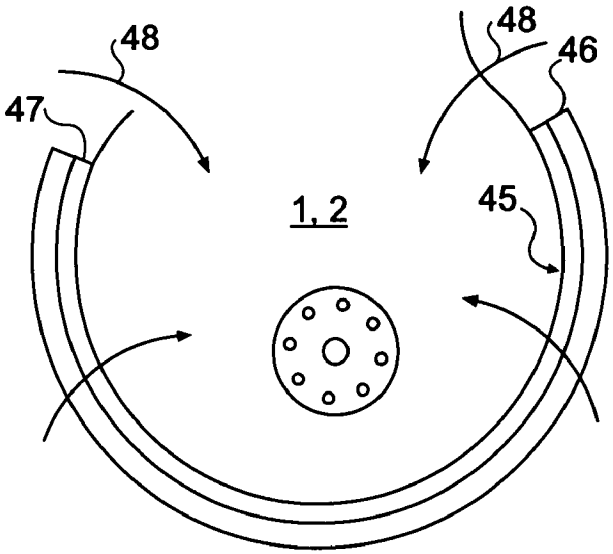
FIG. 18 shows a design of a breast clasp in the form of a bimetal member.

In one particular design the special properties of a bimetal design may be employed, so that the introduced body heat is utilized in such a way that the body heat causes the radius of the bimetal breast clasp to undergo increased contraction, thus providing better adhesion to the body. Thus, FIG. 18 illustrates a bimetal element 45 in the form of a breast clasp 5, 15, 25 comprising two strips 46, 47. One bimetal strip may be designed to be adjustable in length as a function of temperature, and be securely joined to the inner support strip 47. Depending on the influencing temperature (body temperature), the breast clasp is caused to bend in arrow direction 48, or in the opposite direction as a function of temperature.

As previously described for the illustration of different surface structures, the adhesive effect of a breast clasp may be greatly increased by means of roughness or by elements which increase the surface area.

However, these adhesion characteristics could also be greatly increased by applying a soft layer of silicone. Such a silicone layer may be applied by either immersing the breast clasp in a silicone bath or by drawing a silicone tube over the entire length of the breast clasp. In addition, partial silicone coatings or tube elements may be provided at specially selected holding points.

A breast clasp is worn, first of all, by itself as a decorative item on the body, but may also be used as a supplemental decorative element for textiles (bra, dress, sweater, among others). Such a supplemental connection is best achieved by use of miniclips, hook-and-loop fasteners, safety pins, or numerous possible plug-in connections.

Figure 19A:
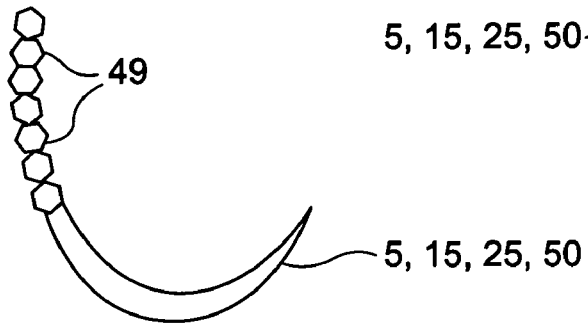
FIG. 19 shows the breast clasp as a base support for decorative elements.
Figure 19B:
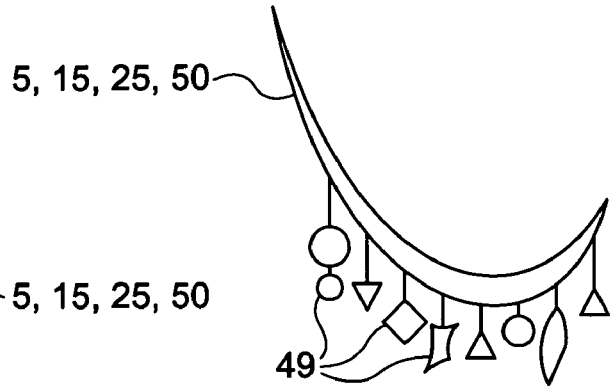
Figure 20:
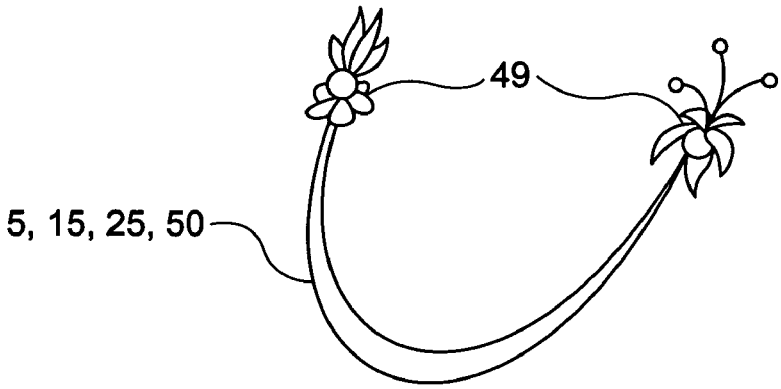
FIG. 20 shows the breast clasp as a support for further decorative elements.

FIGS. 19 and 20 show various decorative elements 49 which are either a part of the breast clasp 5, 15, 25, 50 or may be attached to same.

Likewise, FIG. 20 shows that such decorative elements 49 are provided at each end of the breast clasp 5, 15, 25, 50 to ensure good visibility when low-cut dresses are worn.

Each breast clasp, in and of itself, with its entire surface represents a surface which may be fashioned in any given manner for the attachment of decorative elements.

Shaped elements applied individually as well as over an entire surface may be designed in different "quality values" as "costume jewelry" or "fine jewelry."

It is likewise possible to supplement the individual breast clasp with small pendants of variable design which may be replaced according to the preference of the wearer, thereby offering versatility in design shapes.

In addition to its actual longitudinal course, such a breast clasp, particularly at its terminal extensions, offers the possibility for attaching special decorative elements, either permanently or replaceably. This design as well includes basically limitless design possibilities for decorative use.

Irrespective of scientifically demonstrable effectiveness, in esoterically oriented lifestyles there is often a need to wear particular minerals and semiprecious and precious stones, as well as meteorites, magnets, and other metals, or also "healing components" of other material composition, in direct contact with the body. For such use, a breast clasp represents a support element which is hitherto unknown.

Figure 21:
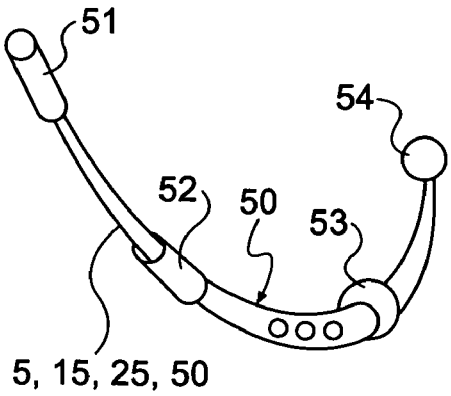
FIG. 21 shows the breast clasp as a support for functional elements.

The breast clasp 50 according to FIG. 21 has various functional elements 51, 52, 53, 54 which may be situated at different locations on the breast clasp itself. As described above, these functional elements 51 may be minerals, semiprecious and precious stones, magnets, metals, or other functional elements which have a corresponding healing effect on the wearer's body.

In particular in the application area of hormone administration, there are increasing numbers of application examples which allow the continuous transfer of active substances by adhesively affixing a hormone depot to the skin. It is conceivable to integrate such active substances in a permeable depot in a breast clasp, thereby introducing active substances in a targeted manner, for example, for the female breast or the entire body. An activity mechanism such as that already employed for flea and tick collars for animals is successfully used.

Figure 22:
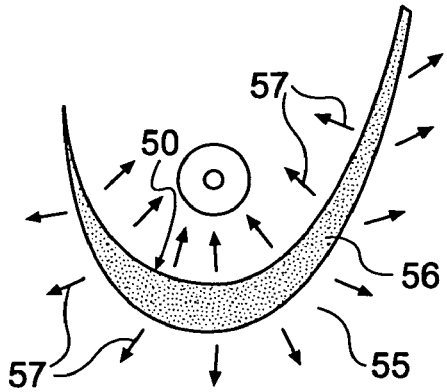
FIG. 22 shows the breast clasp as a carrier for medicaments and chemical substances.

FIG. 22 shows that the breast clasp 50 may also be designed as a hollow body 55 for accommodating an active substance 56, which is delivered through permeable walls into the wearer's body in arrow direction 57.

In one refinement of the invention, a breast clasp is also provided with integrated lighting. Enjoying increased popularity as a typical party, event, or disco product are so-called "glow sticks" which emit fluorescent light over a period of several hours after they are bent from an inactive linear shape, thereby activating their lighting effect. It is conceivable to transfer this action mechanism to such a "light breast clasp."

On the whole, it is concluded that the novel breast clasp provides a completely new appearance for the female body, since it is up to the actual wearer of the breast clasp to decide which portion of the breast clasp is made outwardly visible. It is possible that only the ends of the breast clasp, which are provided with corresponding decorative or functional elements 49, 51-54 are visible in the cleavage. In other embodiments it is also possible for such decorative and functional elements as concealed parts to not be outwardly visible, but to show on the clothing.

According to the present invention, appropriate fragrance depots may also be held by the breast clasp which dispenses fragrances in a controlled manner. Since this area of the body contains a relatively high density of sweat glands, in one refinement of the invention the breast clasp is provided with appropriate deodorizing substances. These deodorizing substances may be provided either as a depot or as a surface.

What is claimed is:

1. Decorative element for the human female body, the decorative element designed as a breast clasp configured to be worn in the crease beneath a female breast, and at that location is held in place by the weight of the breast pressing thereon and also by a clamping effect of the decorative element, the breast clasp comprising at least one half moon-shaped curved clasp, the breast clasp further comprising an individual shape which is ensured by a segmented design of the breast clasp, the segments being secured on a cable, and a desired curved shape is provided corresponding to the tension between the segments, the segments selectively being diamond-shaped, rhomboid, and tetrahedral, and a fit of the breast clasp to the female breast is ensured by radial twisting of the individual segments relative to one another.

2. The decorative element according to claim 1, wherein the breast clasp comprises two separately provided curved clasps.

3. The decorative element according to claim 1, wherein the breast clasp comprises two curved clasps joined together in the center region.

4. The decorative element according to claim 1, wherein the breast clasp has sections which extend along the female breast and are designed as a decorative element, a functional element, or support element.

5. The decorative element according to claim 1, wherein the breast clasp provides a clamping pressure on at least three sides of the breast, which provides a push-up effect on the female breast and shapes same.

6. The decorative element according to claim 2, wherein one breast clasp is designed to be selectively rigidly or flexibly connected to a second breast clasp by means of connecting elements.

7. The decorative element according to claim 1, wherein the breast clasp is designed as a planar element, and/or has a profile shape.

8. The decorative element according to claim 1, wherein the breast clasp selectively has grid elements, shell elements, vertical elements, and fan elements which extend upward toward the female breast and which selectively omit a lower strap and a circumferential, flexible back clasp which at least partially surrounds the human body.

9. The decorative element according to claim 1, wherein the breast clasp has associated shoulder straps.

10. The decorative element according to claim 1, wherein the breast clasp has a three-dimensional deformation in the X-Y-Z plane and provides an improved fit to the female anatomy.

11. The decorative element according to claim 1, wherein the breast clasp is designed as an elastic element, selectively an elastic wire, plastic, plastic/metal composite, which is freely pliable in the X and Y planes but elastically returns to its original shape.

12. The decorative element according to claim 1, wherein the breast clasp is made of a rigid material of only limited flexibility, selectively horn, steel, plastic, which exerts relatively high clamping forces.

13. The decorative element according to claim 1, wherein the breast clasp has a combination of rigid and flexible elements, wherein some sections of the breast clasp have a flexible pliable cross section whereas other sections of the breast clasp have a rigid, nonpliable design.

14. The decorative element according to claim 1, wherein the surface of the breast clasp selectively has smooth, coated, adhesive, roughened, profiled, transverse and longitudinal patterns, knoblike patterns, and planar indentations.

15. The decorative element according to claim 1, wherein the breast clasp is designed as a support element for decorative elements and/or functional elements, and/or as a hollow body which accommodates an active substance which is continuously delivered on the surface of the skin of the human body.

16. The decorative element according to claim 1, wherein the breast clasp is designed as a breast having a circular segment, the circle radius being broken into different lengths for arc angles running in the same direction.

17. The decorative element according to claim 1, wherein the breast clasp has different arc angles which continuously merge into one another.

* * * * *